United States Patent [19]

Araki et al.

[11] 4,307,967

[45] Dec. 29, 1981

[54] SERIAL PRINTING APPARATUS

[75] Inventors: Shigeyuki Araki; Masato Suzuki; Tatsuyuki Nishizawa, all of Tokyo, Japan

[73] Assignee: Ricoh Company, Ltd., Tokyo, Japan

[21] Appl. No.: 124,898

[22] Filed: Feb. 25, 1980

[30] Foreign Application Priority Data

Mar. 4, 1979 [JP] Japan ..... 54-25333
Mar. 4, 1979 [JP] Japan ..... 54-25335

[51] Int. Cl.[3] ..... B41J 1/30

[52] U.S. Cl. ..... 400/144.2; 400/162.2; 400/144.3

[58] Field of Search ..... 400/144.2, 144.3, 163, 400/166, 162.2, 162.3, 322, 328, 51, 52

[56] References Cited

U.S. PATENT DOCUMENTS 4,030,591 6/1977 Martin et al. ..... 400/144.2 X
4,101,006 7/1978 Jensen et al. ..... 400/144.3
4,118,129 10/1978 Grundher ..... 400/144.2
4,178,108 12/1979 Kane ..... 400/144.2
4,189,246 2/1980 Kane et al. ..... 400/144.2
4,226,546 10/1980 Hoffman ..... 400/144.2
4,232,975 11/1980 Kane ..... 400/144.2

*Primary Examiner*—Edward M. Coven
*Attorney, Agent, or Firm*—David G. Alexander

[57] ABSTRACT

A type element (22) is driven across a sheet of paper (24) and a hammer is driven at desired space positions for printing without stopping the type element (22). A length of time required for the type element (22) to select a new character is computed, and a type element drive speed for a next space is computed as a function of the selection time and the present drive speed so that the type element (22) will reach the next space in a length of time substantially equal to the selection time, thereby compensating for acceleration or deceleration of the type element (22).

13 Claims, 22 Drawing Figures

CHANGEOVER
32
VD
VK
31
VELOCITY LATCH
51
INCREMENT MODE CONTROL
DOWN COUNTER
47
HAMMER DRIVE DECODER
48
41
VELOCITY COMPUTER
SPACE WIDTH
56
FUNCTION CONTROL
43
1 ST REGISTER
2 ND REGISTER
3 RD REGISTER
44
45
SELECT TIME COMPUTER
39
FUNCTION REGISTER
54
22
SELECT CONTROL
27
42
SELECT TIME COMPARATOR
SELECTION TIME
SPACE
FUNCTION
PRESENT TYPE ELEMENT POSITION GENERATOR
29
INPUT DECODER
28
DATA IN

Fig. 6

| VELOCITY | TIME PER STEP | HAMMER DRIVE POSITION |
|---|---|---|
| $V_7$ | 0.41 ms/step | —— |
| $V_6$ | 0.70 〃 | 5 steps |
| $V_5$ | 0.95 〃 | 4 〃 |
| $V_4$ | 1.4 〃 | 3 〃 |
| $V_3$ | 2.1 〃 | 2 〃 |

Fig. 7

| RANGE | SELECTION TIME |
|---|---|
| SPACE | —— |
| A | 8 ms Max |
| B | 13 〃 |
| C | 20 〃 |
| D | 30 〃 |

Fig. 8

| | $V_7 \leftrightarrow V_6$ | $V_7 \leftrightarrow V_5$ | $V_7 \leftrightarrow V_4$ | $V_7 \leftrightarrow V_3$ | $V_7 \leftrightarrow$ STOP |
|---|---|---|---|---|---|
| TIME | 3.89 | 5.33 | 6.63 | 7.55 | 9.38 |
| STEPS | 7.5 | 9.3 | 10.5 | 11.0 | 11.4 |

| | $V_6 \leftrightarrow V_5$ | $V_6 \leftrightarrow V_4$ | $V_6 \leftrightarrow V_3$ | $V_6 \leftrightarrow$ STOP |
|---|---|---|---|---|
| TIME | 1.45 | 2.75 | 3.66 | 5.49 |
| STEPS | 1.8 | 3.0 | 3.5 | 3.9 |

| | $V_5 \leftrightarrow V_4$ | $V_5 \leftrightarrow V_3$ | $V_5 \leftrightarrow$ STOP |
|---|---|---|---|
| TIME | 1.30 | 2.22 | 4.05 |
| STEPS | 1.2 | 1.7 | 2.2 |

| | $V_4 \leftrightarrow V_3$ | $V_4 \leftrightarrow$ STOP |
|---|---|---|
| TIME | 0.92 | 2.75 |
| STEPS | 0.6 | 1.0 |

| | $V_3 \leftrightarrow$ STOP |
|---|---|
| TIME | 1.83 |
| STEPS | 0.5 |

Fig. 9

| PRESENT VELOCITY | NEW VELOCITY | TIME FOR 2 SPACES |
|---|---|---|
| $V_7$ | $V_4$ | 25.53 |
| $V_6$ | $V_5$ | 22.54 |
| $V_5$ | $V_5$ | 22.80 |
| $V_4$ | $V_5$ | 22.96 |
| $V_3$ | $V_5$ | 23.41 |
| STOP | $V_5$ | 24.76 |

Fig. 10

| PRESENT VELOCITY | NEW VELOCITY | TIME FOR 2 SPACES |
|---|---|---|
| $V_7$ | $V_3$ | 34.85 |
| $V_6$ | $V_4$ | 32.15 |
| $V_5$ | $V_4$ | 33.22 |
| $V_4$ | $V_4$ | 33.6 |
| $V_3$ | $V_4$ | 34.73 |
| STOP | $V_4$ | 34.95 |

Fig. 11

| PRESENT VELOCITY | TIME FOR SPACE |
|---|---|
| $V_6$ | 8.4 |
| $V_5$ | 8.59 |
| $V_4$ | 9.05 |
| $V_3$ | 9.61 |
| STOP | 11.16 |

Fig. 12

| PRESENT VELOCITY | NEW VELOCITY | TIME FOR SPACE |
|---|---|---|
| $V_6$ | $V_4$ | 15.35 |
| $V_5$ | $V_4$ | 16.42 |
| $V_4$ | $V_4$ | 16.80 |
| $V_3$ | $V_4$ | 16.88 |
| STOP | $V_5$ | 13.36 |

Fig. 13

| PRESENT VELOCITY | TIME FOR SPACE |
|---|---|
| $V_6$ | 21.51 |
| $V_5$ | 23.85 |
| $V_4$ | 24.86 |
| $V_3$ | 25.20 |
| STOP | 25.98 |

Fig. 16

| PRESENT VELOCITY | TIME FOR SPACE |
|---|---|
| $V_7$ | 12.43 |
| $V_6$ | 13.25 |
| $V_5$ | 13.95 |
| $V_4$ | 14.81 |
| $V_3$ | 15.19 |
| STOP | 16.64 |

Fig. 17

| PRESENT VELOCITY | 1ST NEW VELOCITY | CHANGE POSITION | 2ND NEW VELOCITY | TIME FOR SPACE |
|---|---|---|---|---|
| $V_7$ | $V_7$ | 18 | $V_4$ | 20.21 |
| $V_6$ | $V_6$ | 14 | $V_4$ | 20.20 |
| $V_5$ | $V_6$ | 13 | $V_5$ | 20.14 |
| $V_4$ | $V_6$ | 11 | $V_5$ | 20.10 |
| $V_3$ | $V_6$ | 9 | $V_5$ | 20.16 |
| STOP | $V_6$ | 7 | $V_5$ | 23.83 |

Fig. 18

| PRESENT VELOCITY | 1ST NEW VELOCITY | CHANGE POSITION | 2ND NEW VELOCITY | TIME FOR SPACE |
|---|---|---|---|---|
| $V_7$ | $V_7$ | 21 | $V_3$ | 30.84 |
| $V_6$ | $V_6$ | 12 | $V_3$ | 30.79 |
| $V_5$ | $V_5$ | 17 | $V_4$ | 30.35 |
| $V_4$ | $V_5$ | 16 | $V_4$ | 30.06 |
| $V_3$ | $V_5$ | 15 | $V_4$ | 30.06 |
| STOP | $V_5$ | 12 | $V_4$ | 30.06 |

Fig. 19

| PRESENT VELOCITY | 1ST NEW VELOCITY | CHANGE POSITION | 2ND NEW VELOCITY | TIME FOR SPACE |
|---|---|---|---|---|
| $V_6$ | $V_6$ | 9 | $V_4$ | 13.69 |
| $V_5$ | $V_5$ | 10 | $V_4$ | 13.28 |
| $V_4$ | $V_5$ | 4 | $V_4$ | 13.26 |
| $V_3$ | $V_5$ | 4 | $V_4$ | 13.93 |
| STOP | $V_4$ | | | 13.36 |

| PRESENT VELOCITY | 1ST NEW VELOCITY | CHANGE POSITION | 2ND NEW VELOCITY | TIME FOR SPACE |
|---|---|---|---|---|
| $V_6$ | $V_6$ | 9 | $V_3$ | 21.34 |
| $V_5$ | $V_5$ | 9 | $V_3$ | 21.12 |
| $V_4$ | $V_5$ | 5 | $V_3$ | 20.40 |
| $V_3$ | $V_4$ | 5 | $V_3$ | 20.48 |
| STOP | $V_4$ | 3 | $V_3$ | 20.35 |

SERIAL PRINTING APPARATUS

BACKGROUND OF THE INVENTION

The present invention relates to a serial printing apparatus comprising a type element which operates to print continuously without stopping movement of the type element relative to a sheet of paper. Such a printer is known in the art as a flying printing apparatus.

The most simple type of printing apparatus comprising a type element in the form of a daisy wheel, type ball or type cylinder functions to move the type element via a carriage to a desired printing space, stop the carriage, and then energize a hammer to impact the type element against the paper for printing. This procedure is repeated for printing all desired characters. This basic apparatus is unnecessarily slow due to the time required to accelerate the carriage from a stop and decelerate the carriage to a stop for printing each character. The acceleration and deceleration time is essentially wasted.

An improved type of apparatus is known as a flying printer and prints while moving the carriage continuously, or without stopping. This apparatus is much faster than the intermittent or incremental type described above in which the carriage is stopped to print each character due to the elimination of the acceleration and deceleration times.

However, the length of time required to rotate the type element from one position corresponding to a present character to be printed to a new position corresponding to a next character varies considerably in accordance with the present and new characters. The time is zero when the present and new characters are the same and maximum when the new character and present character are located on opposite sides of the type element. In the most simple flying printers, the drive speed for the carriage and type element is maintained constant and corresponds to the maximum selection time. Although faster than the incremental printers, the printing speed is still slower than optimum due to the fact that the actual selection time may be zero or a low value rather than the maximum value and the carriage is being driven unnecessarily slowly.

Another improvement is to calculate a new carriage velocity as a function of the selection time for the next character. This greatly increases the printing speed. However, the printing speed is still not maximized due to the fact that the carriage may have to accelerate or decelerate from the present velocity to the new velocity. The length of time required for the carriage to reach the next space position is relatively low when the carriage decelerates from a high present velocity to the new velocity and vice-versa. For this reason, the new velocity must be selected to allow for deceleration from maximum carriage velocity to the new velocity, or otherwise the carriage will reach the next space position before the character selection is completed. This constraint means that time is wasted since the carriage is driven unnecessarily slowly when the carriage is accelerated from a low present velocity to the new velocity.

SUMMARY OF THE INVENTION

A serial printing apparatus embodying the present invention includes a type element formed with a plurality of characters, drive means for driving the type element relative to a sheet along a plurality of spaces and selector means for moving the type element so that a character corresponding to an input signal assumes a printing position, and is characterized by comprising selection time computer means for computing a selection time required for the selector means to move the type element from a first position corresponding to a first input signal to a second position corresponding to a second input signal, sensor means for sensing a present velocity of the type element relative to the sheet, velocity computer means for computing, as a predetermined function of the selection time and present velocity, a new velocity such that the type element will move from a first space corresponding to the first input signal to a second space corresponding to the second input signal in a length of time substantially equal to the selection time, and control means for commanding the drive means to drive the type element at the new velocity when the type element reaches the first space.

In accordance with the present invention, a type element is driven across a sheet of paper and a hammer is driven at desired space positions for printing without stopping the type element. A length of time required for the type element to select a new character is computed, and a type element drive speed for a next space is computed as a function of the selection time and the present drive speed so that the type element will reach the next space in a length of time substantially equal to the selection time, thereby compensating for acceleration or deceleration of the type element.

It is an object of the present invention to provide a serial printing apparatus which operates at increased speed compared to the prior art.

It is another object of the present invention to provide a serial printing apparatus which performs printing without stopping a carriage and moves the carriage at a maximum possible speed.

It is another object of the present invention to provide a generally improved serial printing apparatus.

Other objects, together with the foregoing, are attained in the embodiments described in the following description and illustrated in the accompanying drawing.

BRIEF DESCRIPTION OF THE DRAWING

FIGS. 6 to 13 are tables illustrating the operation of the present invention;

FIGS. 16 to 20 are tables illustrating the modified operation; and

FIG. 21 is a graph illustrating further modified operation of the present invention.

DESCRIPTION OF THE PREFERRED EMBODIMENTS

While the serial printing apparatus of the present invention is susceptible of numerous physical embodiments, depending upon the environment and requirements of use, substantial numbers of the herein shown and described embodiments have been made, tested and used, and all have performed in an eminently satisfactory manner.

Figures 3, 3A, 3B:
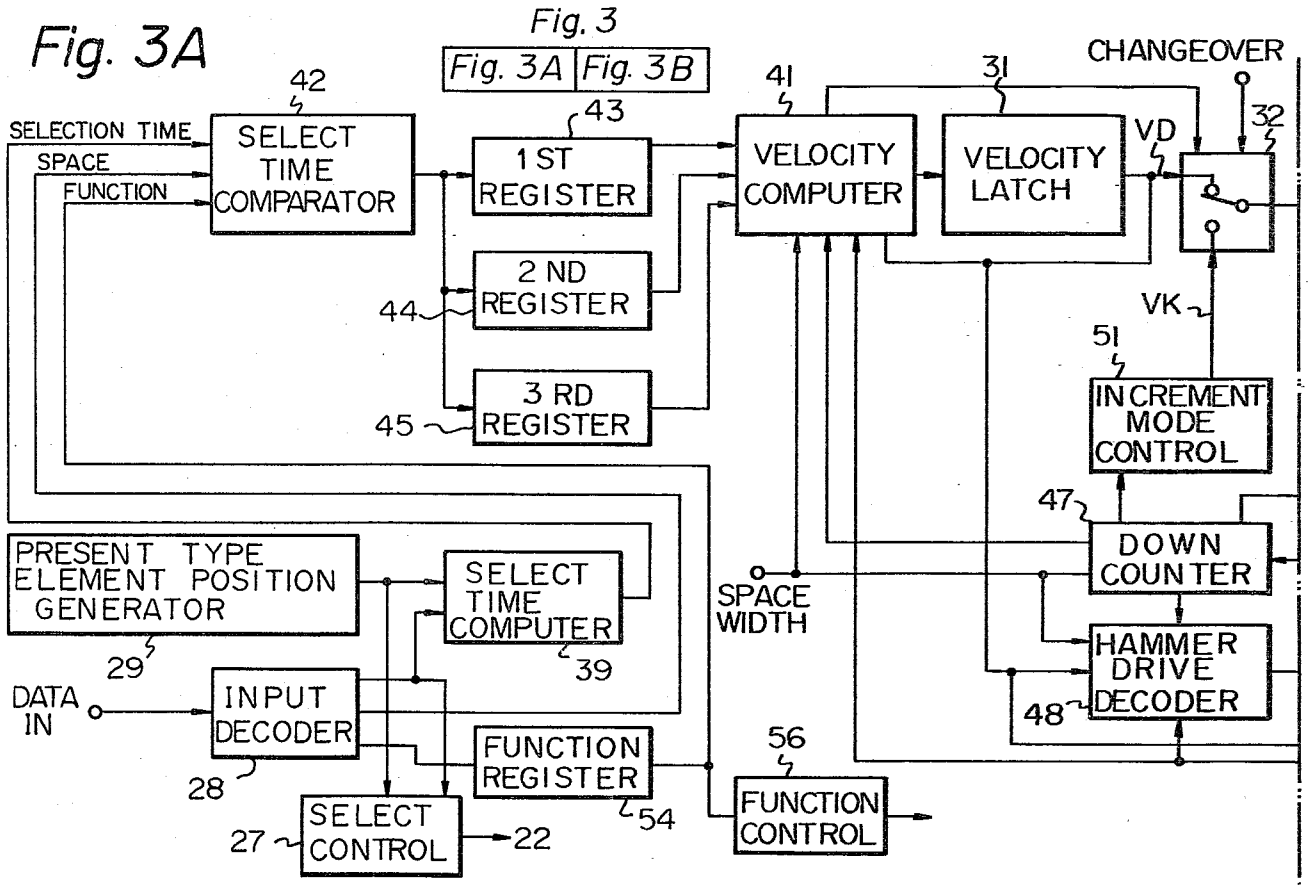
FIGS. 3*a* and *b* together form a block diagram of a serial printing apparatus embodying the present invention.
Figure 3B:
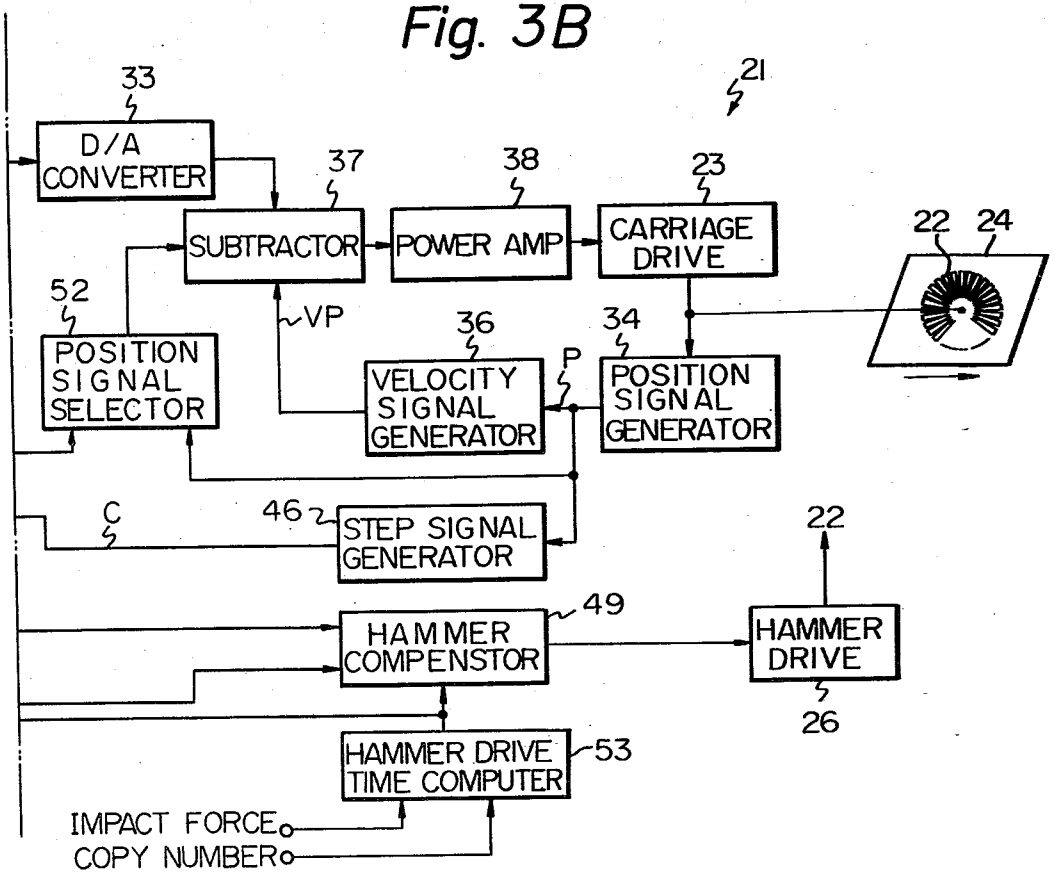

As will become clear from further description of the present invention with reference being made to the block diagram of FIG. 3, the present serial printing apparatus comprises a type element formed with a plurality of characters which is moved along a sheet of paper by a carriage. The type element is rotated so that a desired character is moved to a printing position. Then a hammer is driven to impact the character against the paper for printing. The time required for type selection depends on the initial and final rotational positions of the type element. In the prior art, a new carriage velocity VM is selected so that the carriage will reach a space position in a length of time which is at least equal to the selection time.

Figure 1:
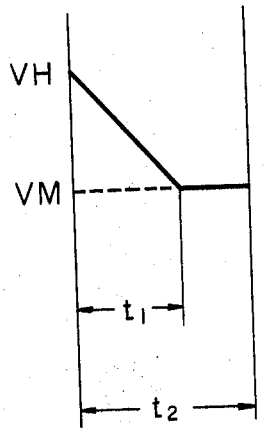
FIGS. 1 and 2 are graphs illustrating the principle of the present invention.

FIG. 1 shows the case when a present velocity VH is higher than the new velocity VM. In this case, assuming constant deceleration, the carriage requires a length of time t1 to decelerate from VH to VM. A total length of time t2 is required for the carriage to move a distance x corresponding to one space. This may be expressed as follows $$x = VMt2 + (VH - VM)\frac{t1}{2} \tag{1}$$

t1 expressed in terms of the acceleration (deceleration) rate a gives $$t1 = \frac{VH - VM}{a} \tag{2}$$

Combining equations (1) and (2) and solving for t2 produces $$t2 = \frac{x}{VM} - \frac{(VH - VM)^2}{2aVM} \tag{3}$$

Figure 2:
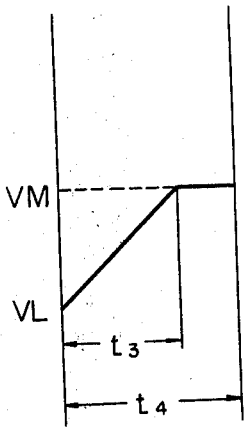

Referring now to FIG. 2, it will be assumed that the present velocity VL is lower than the new velocity VM. In this case, the space distance x is obtained as follows $$x = VMt4 - (VM - VL)\frac{t3}{2} \tag{4}$$

where t3 is the time required for the carriage to accelerate from VL to VM and t4 is the time required for the carriage to move to the next space (by the distance x). The time t3, as a function of acceleration a, is expressed as follows $$t3 = \frac{VM - VL}{a} \tag{5}$$

Combining equations (3) and (4) and solving for t4 produces $$t4 = \frac{x}{VM} + \frac{(VM - VL)^2}{2aVM} \tag{6}$$

Combining equations (3) and (6) and solving for t4−t2 produces $$t4 - t2 = \frac{(VM - VL)^2 + (VH - VM)^2}{2aVM} \tag{7}$$

Assuming that the type selection time is t5, the following relation holds $$t5 < t2 < t4 \tag{8}$$

Thus, VM must be selected so that t2 will be greater than t5 for the highest value of VH. In the prior art, which does not take the present velocity VH or VL into account and satisfies only inequality (8), the carriage is driven unnecessarily slowly when the present velocity is lower than the maximum value of VH by the time t4−t2 of equation (7).

In accordance with the present invention, this problem is overcome by taking into account both the selection time t5, which will be redesignated as t and the present velocity VH or VL. The new velocity VM will be redesignated as V.

$$x = Vt + \frac{(VH - V)^2}{2a} \tag{9}$$

$$x = Vt + \frac{(V - VL)^2}{2a} \tag{10}$$

$$V = (VH - at) + \sqrt{(at)^2 - 2atVH + 2ax} \tag{11}$$

$$V = (VL + at) + \sqrt{(at)^2 + 2atVH + 2ax} \tag{12}$$

In this manner, the new velocity V will be relatively high when the present velocity VL is lower than the new velocity V and relatively low when present velocity VH is higher than the new velocity V. In either case, selection of the new velocity V in accordance with equation (11) or (12) will cause the carriage to move through the space distance x in exactly the selection time t, thereby eliminating any wasted time and always driving the carriage at the maximum possible speed.

Referring now to FIG. 3 of the drawing, a serial printing apparatus embodying the present invention is generally designated by the reference numeral 21 and comprises a type element 22 in the form of a daisy wheel. The type element 22 is formed with a hub and a plurality of spokes which extend therefrom in the radial direction, at least type member or character being formed on each spoke, although not specifically designated by reference numerals. Rotation of the type element 22 to a particular angular position places a corresponding character in a printing position. A carriage drive unit 23 moves the type element 22 along a line of spaces on a sheet of paper 24. A hammer drive unit 26 is energized when the type element 22 reaches a desired space for printing to move a hammer (not shown) to engage the type element 22 and impact the selected or desired character against the sheet 24 through a ribbon (not shown) for printing. The type element 22 is rotated to place the desired character in the printing position by a select control unit 27.

More specifically, input data signals are decoded by an input decoder 28. Typically, the input data signals are in the well known ASCII format and generated by an input keyboard, read out of a memory in a word processor or computer or the like. It will be assumed that an input signal corresponding to a character has been received and decoded and that the select control unit 27 is in the process of rotating the type element 22 to place the corresponding character in the printing position. The type element 22 is movable along the paper 24 between incremental spaces, with each space being equal in width to a distance between adjacent printed characters. The carriage drive unit 23 is in the process of moving the type element 22 to the space at which it is desired to print the character. When the type element 22 is a certain predetermined distance from the printing space which corresponds to the length of time required for the hammer to impact the character or type member against the paper 24, the hammer drive unit 26 is energized to start moving the hammer. In this manner, the hammer impacts the type element 22 against the sheet 24 at exactly the desired printing space position. The input data signal corresponding to the character which is in the process of being printed will be designated as a first input signal. The space at which the character corresponding to the first input signal is to be printed is designated as a first space. The next adjacent space will be designated as a second space. The character to be printed in the second space corresponds to a second input signal. It will further be assumed that the second input signal has been received before the type element 22 reaches the first space.

A present carriage or type element velocity relative to the sheet 24 is stored in a velocity latch 31 in digital form and designated as VD. The signal VD is passed through a switch unit 32 to a digital to analog (D/A) converter 33 which converts the signal VD into an analog velocity signal VA. The carriage and type element 22 are controlled to move at a velocity corresponding to the signals VD and VA by a servo loop as will be described in detail below.

A present type element position generator unit 29 is connected to the shaft of the type element 22 and generates a signal which indicates the actual present rotational position of the type element 22. The select control unit 27 compares the actual present position with a position corresponding to the first input signal and drives the type element 22 in the rotational direction to reduce the difference to zero. When the type element 22 reaches the first space, the desired character is in the printing position, the hammer impacts the type member of the type element 22 bearing the character against the paper 24 and the character is printed. At this time, the signal VA corresponds to the present velocity of the type element 22 at the time the type element 22 is in the first space position and the generator unit 29 produces a signal corresponding to the angular position of the type element 22 for the character corresponding to the first input signal.

The type element 22 is controlled to the velocity indicated by the signal VA by a servo loop which comprises a position signal generator 34. The generator 34, although not illustrated in detail, typically comprises a slotted disc rotatable with the type element 22. A light source and photosensor are disposed on opposite sides of the slots of the disc in such a manner that the photosensor produces a quasisinusoidal signal P as the photosensor is alternately covered and uncovered by the opaque areas between the slots.

The position signals are applied to a velocity signal generator 36 which produces an actual velocity signal VP which corresponds to the actual velocity of the type element 22 relative to the paper 24. The signals VA and VP are applied to a subtractor 37 which produces a signal proportional to the difference between the signals VA and VP. This signal is an error signal which is fed through a power amplifier 38 to the carriage drive unit 23. In this manner, the carriage drive unit 23 varies the actual velocity of the type element 22 so as to reduce the difference between the signals VA and VP to zero. Thus, the type element 22 is controlled to move at the velocity corresponding to the signal VA.

It will be recalled from the above description that at the time of printing of the character corresponding to the first input signal, the present velocity is indicated by VA, the angular position of the type element 22 corresponding to the character for the first input signal is output by the generator unit 29 and the second input signal indicating the next character for printing has been received. These conditions enable computation of a new velocity for the type element 22 in accordance with the present invention.

The output of the generator unit 29 and the decoded second input signal are applied to a select time computer 39. The computer 39 compares the angular position of the type element 22 for the first character with the required angular position for the second character and produces a signal indicating the selection time, or the length of time required for the type element 22 to rotate from the first position to the second position. For a daisy wheel or cylindrical type element which has multiple characters for each angular position which are selected by a combination of rotation and translation, the select time computer 39 computes the total length of time for type selection including both rotation and translation of the type element 22. The selection time is applied to a velocity computer 41 via a select time comparator 42 and first to third registers 43 to 45 respectively as will be described in detail below. The present velocity is applied to the velocity computer 41 from the velocity latch 31 as the signal VD. The velocity computer 41 computes a new velocity for movement of the type element 22 from the first space to the second space in accordance with the selection time and the present velocity so that the type element 22 will reach the second space at the termination of the selection time. In other words, the length of time required for the type element 22 to move from the first space to the second space is substantially equal to the selection time. This is accomplished by optimal computation of the new velocity as described with reference to FIGS. 1 and 2 and equations (11) and (12). The new velocity signal is latched into the velocity latch 31 and applied to the subtractor 37 as a new value of VA.

The position signal P is converted into a train of square wave step pulses C by a step signal generator 46. The pulses C correspond to the alternations of the signal P. Typically, there are twelve steps between adjacent spaces, so that the step signal generator 46 will produce twelve step pulses C between adjacent spaces. A down counter 4 is preset to the count of twelve when the type element 22 is in the first space position and is decremented by the step pulses C. The count in the counter 47 will be zero when the type element 22 reaches the second space position.

The output of the counter 47 is applied to a hammer drive decoder 48. The decoder 48 also receives the signal VD and computes the number of steps before the second space position at which the hammer should be driven so that the type element 22 impacts the paper 24 at the second space position. The signal VD and the output of the hammer drive decoder 48 are applied to a hammer compensator unit 49 which energizes the hammer drive unit 26 at the proper time. The decoder 48 produces an output which is fed to the hammer compensator unit 49 when the computed or predetermined hammer drive step is equal to the count in the counter 47.

In order to reduce the amount of electronic circuitry and thereby the cost and compelxity of the apparatus 21, the velocity signal VD and thereby the analog velocity signal VA are adapted to have a plurality of discrete values, more specifically V1 to V7 in addition to zero. The velocity values V1 and V2 are not related to the operation of the present invention and will not be described further. The velocity progressively increases from V3 to V7. The value V7 is not used for printing but only for high speed nonprinting spacing.

The number of steps before the desired space position at which the hammer is to be energized for printing is given in tabular form in FIG. 6. It is assumed that the type element 22 is moving a constant velocity from the time the hammer is energized until impact. For example, if the carriage velocity is V6, the hammer must be driven 5 steps prior to the printing position. The length of time required to move by one step is 0.7 ms. The table assumes that the length of time between energization of the hammer and impact is 3.5 ms. Thus, at a carriage (and type element 22) velocity of 0.7 ms/step, the hammer drive position is (3.5 ms impact time)/(0.7 ms/step)=5 steps.

The selection time is also divided into a plurality of ranges A to D. The selection time for a blank space is zero. The range A includes selection times from zero to 8 ms. The range B is from 8 ms to 13 ms. The range C is from 13 ms to 20 ms. The range D is from 20 ms to 30 ms. The select time comparator 42 compares the selection time with the range values shown in FIG. 7 and produces a range signal indicating the range in which the selection time lies. The range value is stored in the registers 43 to 45.

More specifically, the range value for the second input signal is stored in the first register 43. The range signals for third and fourth input signals which consecutively follow the second input signal are stored in the registers 44 and 45 respectively. Typically, the registers 43 to 45 constituted by a shift register in which the range signals are shifted from the third register 45 through the second register 44 to the first register 43 at respective space positions.

FIG. 8 is constituted by a group of tables indicating the length of time in milliseconds and the number of steps required for acceleration or deceleration between the various velocities of zero or stop and V3 to V7. These values are calculated using the following equations $$t6 = \frac{|V - V1|}{a} \tag{13}$$

$$x1 = \frac{|V^2 - V1^2|}{2a} \tag{14}$$

where t6 is the required acceleration or deceleration time, V is the new velocity, V1 is the velocity before acceleration and deceleration, x1 is the number of steps required for the velocity change (from V1 to V) and a is the constant acceleration or deceleration factor which is assumed to have a value of 0.26 steps/ms$^2$. The new velocity V is selected in accordance with values calculated by the following equation $$t7 = t6 + [t8(12 - t1] \tag{15}$$

where t7 is the length of time required for the carriage to move by one space and t8 is the length of time required for the carriage to move one step at constant velocity as tabulated in FIG. 6. It will be understood that t6 and x1 are tabulated in FIG. 8. The velocity computer 41 comprises a memory which stores look-up tables listed as FIGS. 9 to 13, a decoder which decodes the contents of the registers 43 to 45 and a selector which produces as an output one of the velocity values V3 to V7 or zero, although not specifically illustrated. The operation of the velocity computer 41 will now be described with reference being made to the tables of FIGS. 9 to 13.

The following conventions will be used hereafter.

The contents of the registers 43 to 45 will be designated as A, B, C, D, S, X, Z or 0. The designations A, B, C and D correspond to the selection time ranges. The designation S indicates a blank (non-printing) space. The designation X indicates that the contents of the register are irrelevant, and may be A, B, C, D, S or 0. The designation 0 means that an input signal has not been received and stored in the register. The designation Z includes A, B, D, D and S but not 0.

Case 1: 43=S, 44=S, 45=0

In this case, blank spaces are stored in the registers 43 and 44 and no input signal has been received for the register 45. The carriage is driven in a two space incrementation mode which will be described in detail below. In the two space incrementation mode, the carriage and type element 22 are moved two spaces and stopped in the second space position.

Case 2: 43=S, 44=S, 45=Z

In this case, blank spaces are stored in the registers 43 and 44 as above but a fourth input signal has been received and the corresponding value stored in the register 45. The signal in the register 45 may be anything including a blank space. In this case, the carriage is driven at the maximum velocity V7 for two spaces.

Case 3: 43=S, 44=A or B, 45=X

In this case, the velocity V6 is selected and the carriage driven at V6 for two steps. In accordance with FIG. 7, it will be understood that the maximum selection time is 13 ms and the carriage will preferably move by two spaces in exactly 13 ms. However, in practice using discrete velocity values, the time required for the carriage to move by two spaces varies and will be somewhat greater than 13 ms. The difference between the actual time of movement and the selection time is made as small as possible. For example, where the present velocity is V7 and the new velocity is V6, the actual time required for movement by two spaces is given by modifying equation (15) for two space movement rather than one space movement as follows.

time for two space movement
= 3.89ms + [0.70ms/step(24 steps - 7.5 steps)]
+ 15.44ms This is slightly greater than 13 ms. Since it is desirable for the carriage and type element 22 to be moving at constant velocity at the time the hammer is energized, it is necessary to command V6 for two steps rather than V7 for one step and V6 for one step. This is because at V6 the hammer must be driven 5 steps prior to the space position and 7.5 steps are required for deceleration from V7 to V6. Thus, V6 must be commanded 12.5=5+7.5 steps prior to the printing space position which is greater than the number of steps for one space which is 12.

The maximum movement time for the two steps occurs when the present velocity is zero, or the carriage and type element 22 are at a stop. The actual value is as follows.

time for two space movement
= 5.49ms + [0.7ms/step(24 steps - 3.9 steps)]
= 19.56ms The type selection is begun as soon as the printing operation is completed.

Case 4: 43=S, 44=C, 45=0

In this case, the carriage is driven for two space movement which must be accomplished in a length of time not less than the maximum selection time for range C which is 20 ms. Where 45=0, the carriage is driven in the two space incrementation mode and stopped.

Case 5: 43=S, 44=C, 45=Z

Where data has been received for the register 45, the new velocity is selected in accordance with the present velocity. The time of movement for two steps must be greater than the maximum selection time for range C which is 20 ms as in case 4. The new velocity is selected as shown in FIG. 9. For example, if the present velocity is V3, the new velocity is V5 and the time for two space movement is 23.41 ms which is greater than 20 ms. As above and in the further cases, the type selection is begun as soon as the previous printing operation is completed.

Case 6: 43=S, 44=D, 45=0

In this case, the two space incrementation mode is selected.

Case 7: 43=S, 44=D, 45=Z

The carriage is moved for two spaces in a length of time which must exceed 30 ms, the maximum selection time for range D. The new velocity is selected as a function of the present velocity as shown in FIG. 10.

Case 8: 43=A, 44=0, R3=X

In this case a one space incrementation mode is selected. In other words, the carriage is moved by one space and stopped.

Case 9: 43=A, 44=Z, 45=X

In this case the new velocity is V6 regardless of the present velocity. The movement time for one space must exceed the maximum selection time for range A which is 8 ms. FIG. 11 lists the movement times for various values of present valocity, and in each case the one space movement time exceeds 8 ms.

Case 10: 43=B, 44=0, 45=X

The one space incrementation mode is selected for the above values in the registers 43, 44 and 45.

Case 11: 43=B, 44=Z, 45=X

In this case, the carriage must move one space in a length of time which slightly exceeds 13 ms, the maximum selection time for range B. The new velocity is selected as shown in FIG. 12.

Case 12: 43=C, 44=0, 45=X

The one space incrementation mode is selected under these conditions. However, if the first input signal corresponded to a blank space and type selection for the second input signal has been completed, V6 is selected.

Case 13: 43=C, 44=Z, 45=X

The velocity V3 is selected regardless of the present velocity. The times required for one space movement are shown for reference in FIG. 13.

Case 14: 43=D, 44=X, 45=X

In this case the one space incrementation mode is selected. Printing in the flying mode cannot be accomplished since the maximum possible length of time which is for accelerating from stop to V3 takes 25.98 ms, which is shorter than the maximum selection time for range D which is 30 ms.

It is desirable in the art to control serial printers of the present type using microcomputers. In such a case, the units 39, 42, 43, 44, 45, 41 and 31 are constituted by a combination of hardware and software.

Figure 4:
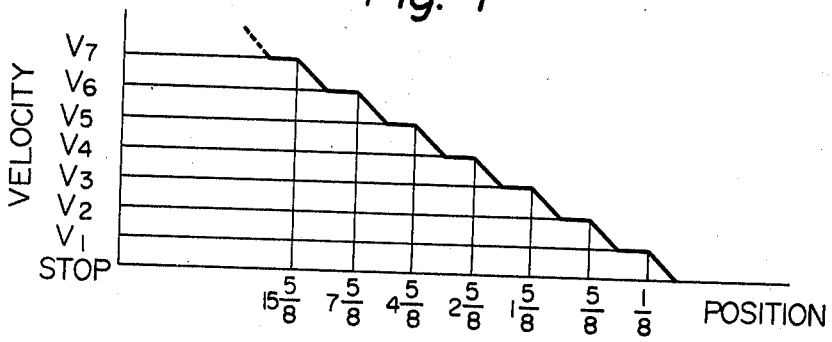
FIGS. 4 and 5 are diagrams illustrating the operation of the present invention in an incremental printing mode.
Figure 5:
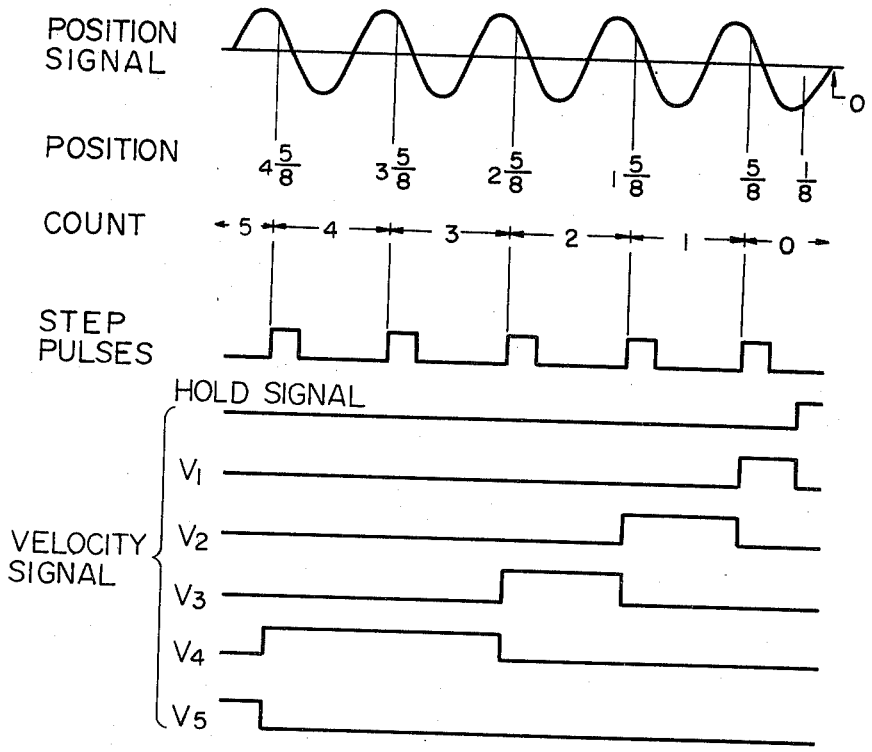

The incrementation mode is illustrated in FIGS. 4 and 5. The step pulses C are generated as being displaced by $\frac{5}{8}$ step position from the actual step positions which occur at the rising zero crossings of the position signal P. Further illustrated is the count of the counter 47. The incrementation mode is controlled by an increment mode control unit 51. When the incrementation mode is required, a changeover signal is applied to the switch unit 32 causing the converter 33 to select the output of the unit 51 rather than the unit 31. The increment mode control unit 51 changes an incremental velocity signal VK as shown in FIGS. 4 and 5.

The velocity signal VK is initially V7 and decreased to V6 at the 15 step position. It is reduced to V5 at the 7 step position, to V4 at the 4 step position, etc. down zero at the zero step position. When the count in the counter 47 goes to zero and the carriage reaches the $\frac{1}{8}$ step position, a position signal selector unit 52 connects the position signal, rather than the velocity signal Va, to the subtractor 37 as a hold signal to hold the type element 22 and carriage in the zero step position.

The hammer compensator 49 is designed to compensate for a difference between an actual (non-integral) step position at which hammer drive should begin and an integral count in the counter 47. For example, suppose that the actual hammer drive position is 2.5 steps for V3. However, the hammer drive decoder 48 will produce an output 3 steps before the printing position. If the hammer were driven at the time the decoder 48 produced the output, the hammer would cause the type element 22 to impact the paper 24 too soon and the character would be displaced to the left of the proper position. To overcome this problem, the compensator unit 48 computes the difference between the output step of the decoder 48 (in this case 3 steps) and the actual proper hammer drive position (in this case 2.5 steps) and divides this distance by the speed of movement of the carriage (in this case V3=1/(1.4 ms/step)=0.71 steps/ms) to obtain the difference which is 0.7 ms. The hammer compensator unit 49 then functions to delay the hammer drive for 0.7 ms after the carriage reaches the 3 step position and the decoder 48 produces the output signal. This ensures that the hammer will cause the type element 22 to impact the paper 24 at exactly the proper position. A space width signal is also applied to the velocity computer 41, down counter 47 and hammer drive decoder 48 to adjust the space width and hammer drive position for variations in space width such as in a proportional printing system.

Further illustrated is a hammer drive time computer 53 which computes adjustments to the hammer drive time in accordance with the type element 22 impact force and number of copies being printed via interceeding carbon sheets. The impact force is variable in accordance with the area of the character being printed so that all characters will be printed with equal density. The impact force is increased as the character area increases. The hammer drive time computer 53 has an output connected to the velocity computer 41, hammer drive decoder 48 and hammer compensator unit 49 to compensate the new velocity and hammer drive time for these variations.

The apparatus 21 is also capable of performing non-printing functions such as changeover between black and red ribbons in accordance with corresponding input signals. The functions are decoded by the decoder 28 and stored in a function register 54. The output of the register 54 is applied to a function control unit 56 which causes the appropriate section of the apparatus 21 to perform the function. However, the present invention is adapted to improve on the usual function operation as embodied by the prior art.

Figures 20, 21:
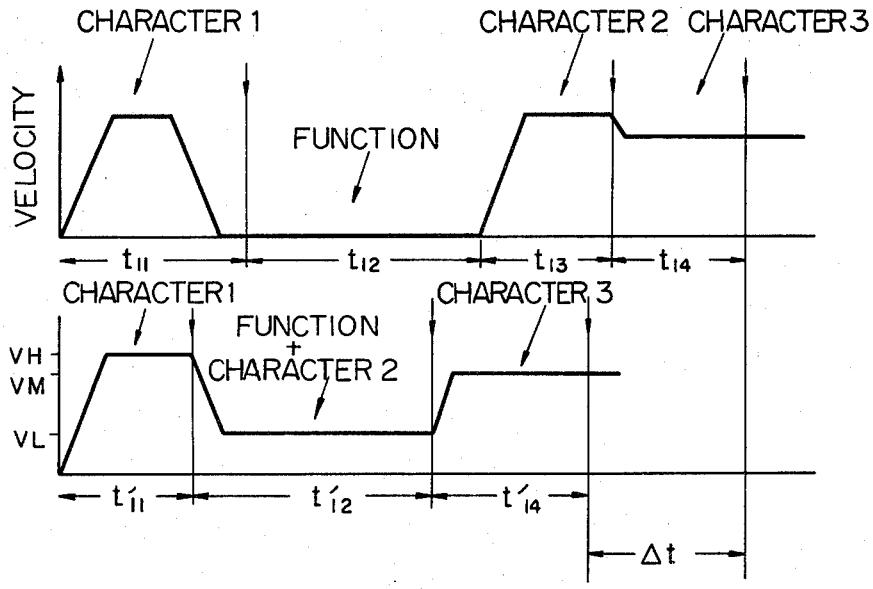
Fig. 21 PRIOR ART

FIG. 21 illustrates, in the upper portion, the operation on a first character, a function, a second character and a third character in accordance with the prior art. The first character is printed in a time t11 and the carriage is stopped for a time t12 in which the function is performed. The second character is printed in a time t13 and the third character is printed in a time t14.

In accordance with the present invention, the time t12 required to perform the function is compared with the time t13 required to print the second character and the function and type selection for the second character performed simultaneously. The carriage is not stopped, but is driven at a new velocity corresponding to the longer of the times t12 and t13, in this case t12. In this manner, the operation of the apparatus 21 is yet further speeded up by eliminating the necessity of stopping the carriage to perform the function. In this case, the operation is shortened by a length of time $\Delta t$ which is equal to t13+(t11−t11′).

FIGS. 14 to 20 illustrate a modification of the present inventiion which enables yet further increased printing speed. It will be noted from FIGS. 9 to 13 that the times required for carriage movement often exceed the maximum type selection times for the respective ranges. This produces a time loss equal to $$(x/VE)-(x/VF) \tag{16}$$

where VE is the discrete velocity actually commanded and VF is the velocity computed in accordance with equation (11) or (12). This is improved upon as illustrated in FIGS. 14 and 15 by initially commanding a first high new velocity and changing to a second lower new velocity at a predetermined distance before the printing step position.

Figure 14:
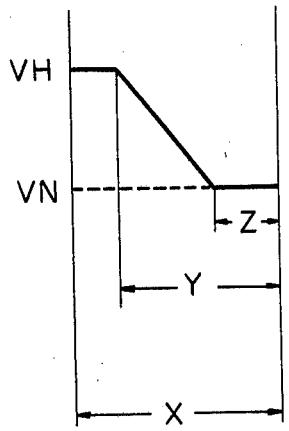
FIGS. 14 and 15 are graphs illustrating modified operation of the present invention.

In FIG. 14, the second new velocity VN is below the present velocity VH. In this case, the present velocity VH is maintained as the first new velocity until the carriage reaches a distance y from the printing position at which time the velocity command is reduced to VN. The velocity will decelerate to VN at distance z ahead of the printing position.

Figure 15:
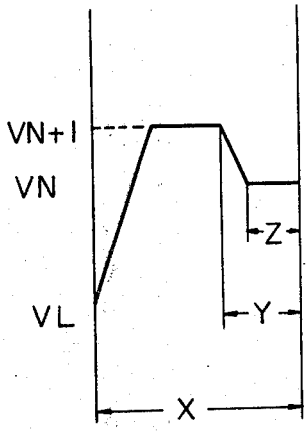

In FIG. 15, the second new velocity VN is above the present velocity VL. In this case, a first new velocity VN+1 is initially commanded and the velocity command reduced to VN at the distance y. This enables the movement times to more closely approximate the maximum selection times for the ranges A to D.

A time t15 at which the second new velocity VN is selected after commanding the first new velocity VH is as follows $$t15 = \frac{x-y}{VH} + \frac{VH-VN}{a} + \frac{z}{VN} \tag{17}$$

$$z = y - \frac{VH^2 - VN^2}{2a} \tag{18}$$

Combining equations (17) and (18) gives the distance y as follows $$y = \frac{VH(VH-VN)}{2a} - \frac{VN(x-VHt15)}{VH-VN} \tag{19}$$

The corresponding equations where the first new velocity is VN 1 are as follows $$t15 = \frac{VN+1-VL}{a} + \frac{VN+1-VN}{a} + \frac{1}{VN+1}\left(x - \frac{VN+1^2 - VN^2}{2a}\right)\frac{z}{VN} \tag{20}$$

$$z = y - \frac{VN+1^2 - VN^2}{2a} \tag{21}$$

$$y = VNt15 + \frac{VN(2VL-VN+1)+(VN+1-VN)^2}{2a} - \frac{VN}{VN+1} + \frac{VN^2}{2a} \tag{21}$$

It is also possible to increase, rather than decrease, the movement times using the above equations to enable flying printing for long selection times such as in the range D. In such a case, the first new velocity is made low and the second new velocity is made high.

The operation in accordance with the modified embodiment is the same as the previous embodiment except as follows.

Case 3: 43=S, 44=A, 45=X

The first new velocity is V7 and the second new velocity is V6 changed 13 steps before the second space position. The times are shown in FIG. 16.

Case 3: 43=S, 44=B, 45=X

Where the present velocity is V7, the first new velocity is V7 and is changed to V6 15 steps before the second space position to enable a movement time for the two spaces in excess of 13 ms. The actual movement time is $0.41\times 8\frac{3}{8}+3.89+0.70\times 8\frac{1}{8}=13.01$ ms.

Where the present velocity is other than V7, the first new velocity is V7 and is changed to V6 13 steps before the second step position.

Case 5: 43=S, 44=C, 45=Z

The first and second new velocities are selected in accordance with FIG. 17.

Case 7: 43=S, 44=D, 45=Z

The first and second new velocities are selected in accordance with FIG. 18.

Case 11: 43=B, 44=Z, 45=X

The first and second new velocities are selected in accordance with FIG. 19.

Case 13: 43=C, 44=Z, 45=X

The first and second new velocities are selected in accordance with FIG. 20.

Comparison of FIGS. 16 to 20 with the corresponding FIGS. 8 to 13 for the basic embodiment will show how the movement time is further reduced and the operating speed of the printing apparatus increased.

In summary, it will be seen that the present invention provides an improved serial printing apparatus which eliminates wasted time and thereby operates at maximum possible speed which is a major improvement over the prior art. Various modifications will become possible for those skilled in the art after receiving the teachings of the present disclosure without departing from the scope thereof.

What is claimed is:

1. A serial printing apparatus including a type element formed with a plurality of characters, drive means for driving the type element relative to a sheet along a plurality of spaces and selector means for moving the type element so that a character corresponding to an input signal assumes a printing position, characterized by comprising:

selection time computer means for computing a selection time required for the selector means to move the type element from a first position corresponding to a first input signal to a second position corresponding to a second input signal;

sensor means for sensing a present velocity of the type element relative to the sheet;

velocity computer means for computing, as a predetermined function of the selection time and present velocity, a new velocity such that the type element will move from a first space corresponding to the first input signal to a second space corresponding to the second input signal in a length of time substantially equal to the selection time; and control means for commanding the drive means to drive the type element at the new velocity when the type element reaches the first space.

2. An apparatus as in claim 1, further comprising hammer means for impacting the type element against the sheet for printing and distance sensor means for sensing a distance between the type element and a desired printing space and energizing the hammer means when said distance is equal to a predetermined distance at which a hammer time required for the hammer means to impact the type element against the sheet is equal to a time required for the type element to reach the desired printing space.

3. An apparatus as in claim 2, in which the distance sensor means comprises hammer time computer means for computing said predetermined distance as a function of the present velocity.

4. An apparatus as in claim 2, in which the distance sensor means comprises hammer time computer means for computing said predetermined distance as a function of the present velocity, a desired impact force corresponding to a selected character and a number of copies to be printed.

5. An apparatus as in claim 2, in which the velocity computer means is adapted to compute the new velocity such that the type element will be moving a constant velocity at said predetermined distance.

6. An apparatus as in claim 2, in which the distance sensor means is constructed to sense the distance in discrete increments, the hammer means comprising correction computer means for computing and applying a correction corresponding to a difference between the predetermined distance and a distance increment produced by the distance sensor means.

7. An apparatus as in claim 1, in which the velocity computer means is constructed to compute the new velocity in accordance with the following equation when the present velocity is higher than the new velocity $$V = (VH - at) + \sqrt{(at)^2 - 2atVH + 2ax}$$

and in accordance with the following equation when the present velocity is lower than the new velocity $$V = (VL + at) + \sqrt{(at)^2 + 2atVL - 2ax}$$

where V is the new velocity, VH is a present velocity which is greater than the new velocity, VL is a present velocity which is lower than the new velocity, a is a rate of acceleration of the type element relative to the sheet, t is the selection time and x is a distance between adjacent spaces.

8. An apparatus as in claim 1, in which the selection time computer means is constructed to compare the selection time with a plurality of selection time ranges and produce a range value corresponding to a range which contains the selection time, the present velocity having one or a plurality of discrete values, the velocity computer means being responsive to the range value and the present velocity value and producing the new velocity having one of the discrete velocity values in accordance therewith.

9. An apparatus as in claim 1, in which the velocity computer means is constructed to compute a second new velocity which is lower than said new velocity as a function of the present velocity and selection time, the control means controlling the drive means to drive the type element at said new velocity when the type element reaches the first space and subsequently to drive the type element at the second new velocity when the type element reaches a predetermined distance from the second space.

10. An apparatus as in claim 1, in which the control means is constructed to selectively control the drive means to operate in an incremental mode in which the type element is stopped at a desired space.

11. An apparatus as in claim 10, in which the control means is constructed to control the drive means to operate in the incremental mode for two spaces when the second input signal and a third input signal correspond to blank spaces and a fourth input signal has not been received.

12. An apparatus as in claim 10, in which the control means is constructed to control the drive means to operate in the incremental mode for one space when a third input signal has not been received.

13. An apparatus as in claim 1, in which the control means comprises function time computer means for computing a function time required for the apparatus to perform a non-printing function corresponding to an input signal and maximum time computer means responsive to outputs of the selection time computer means and the function time computer means for computing a maximum time which is equal to a greater of the selection time and the function time, the control means, when the second input signal corresponds to a function and a third input signal corresponds to a character, controlling the velocity computer means to compute the new velocity in accordance with the maximum time, controlling the apparatus to perform the function and controlling the selector means to select said character when the type element reaches the first space.

* * * * *